US008844246B2

(12) United States Patent
Perick et al.

(10) Patent No.: US 8,844,246 B2
(45) Date of Patent: Sep. 30, 2014

(54) FILM LAMINATE FOR THE PRODUCTION OF BAGS WITH AN INTEGRATED FILM HANDLE, AND METHOD FOR THE PRODUCTION OF THE LAMINATE

(75) Inventors: Matthias Perick, Ahaus-Altstaette (DE); Markus Wielens, Ahaus (DE)

(73) Assignee: Mondi Consumer Packaging Technologies GmbH, Gronau (DE)

( * ) Notice: Subject to any disclaimer, the term of this patent is extended or adjusted under 35 U.S.C. 154(b) by 158 days.

(21) Appl. No.: 13/294,353

(22) Filed: Nov. 11, 2011

(65) Prior Publication Data

US 2012/0144782 A1 Jun. 14, 2012

(30) Foreign Application Priority Data

Nov. 17, 2010 (EP) ..... 10191569

(51) Int. Cl.
*B65B 29/04* (2006.01)
*B65D 75/56* (2006.01)

(52) U.S. Cl.
CPC ..... *B65D 75/566* (2013.01); *B65B 29/04* (2013.01); *B31B 2219/9096* (2013.01)
USPC ..... 53/413

(58) Field of Classification Search
CPC ..... B65B 29/04; B65B 61/14; B65B 29/02; B65B 9/15; B65B 51/04; B65B 9/067; B31B 2219/9096; B65D 75/566
USPC ..... 53/413, 134.1, 450, 451, 550, 551; 493/926
See application file for complete search history.

(56) References Cited

U.S. PATENT DOCUMENTS

| | | | | |
|---|---|---|---|---|
| 5,026,173 | A * | 6/1991 | Jensen | 383/10 |
| 5,393,293 | A * | 2/1995 | Cilia et al. | 493/341 |
| 5,467,915 | A * | 11/1995 | Mattson | 229/117.24 |
| 6,185,908 | B1 * | 2/2001 | Madderom | 53/415 |
| 6,500,559 | B2 * | 12/2002 | Hofmeister et al. | 428/474.4 |
| 6,957,915 | B2 * | 10/2005 | Tankersley | 383/109 |

(Continued)

FOREIGN PATENT DOCUMENTS

| | | |
|---|---|---|
| DE | 25 31 038 | 1/1977 |
| DE | 84 28 169 | 12/1984 |

(Continued)

OTHER PUBLICATIONS

European Search Report dated Apr. 13, 2011 in European Patent Application No. EP 10 19 1569 with English translation of relevant parts.

*Primary Examiner* — Sameh Tawfik
(74) *Attorney, Agent, or Firm* — Collard & Roe, P.C.

(57) ABSTRACT

A film laminate wound up to form a film roll, from which bags with an integrated handle are produced in a VFFS form-fill and seal bag machine. The film laminate is produced by coating a film web of an outer film with a lamination adhesive and applying a material web of a sealable film to the adhesive layer. The material web is pressed together with the film web and adhesive layer in a lamination gap between a lamination roller and a pressing roller. A reinforcement strip passed to the lamination gap contacts the adhesive layer, between the film web and the sealable film. The circumference surface of the pressing roller has a depression that is coordinated with the film thickness and the film width of the reinforcement strip, so that a uniform pressing pressure prevails in the lamination gap, over the entire width of the laminate.

8 Claims, 5 Drawing Sheets

(56) References Cited

U.S. PATENT DOCUMENTS

| | | | | |
|---|---|---|---|---|
| 7,065,937 | B2 * | 6/2006 | Tankersley | 53/411 |
| 7,716,901 | B2 * | 5/2010 | Price | 53/413 |
| 8,230,664 | B2 * | 7/2012 | Prizzi et al. | 53/133.3 |
| 2008/0273821 | A1 * | 11/2008 | Doll | 383/209 |
| 2009/0202181 | A1 | 8/2009 | Alaux | |
| 2009/0205291 | A1 * | 8/2009 | Antonevich et al. | 53/450 |
| 2011/0094193 | A1 * | 4/2011 | Daelmans et al. | 53/451 |

FOREIGN PATENT DOCUMENTS

| | | |
|---|---|---|
| DE | 20 2009 012 135 | 11/2009 |
| FR | 2 903 083 | 1/2008 |
| WO | WO 2008/038308 | 4/2008 |
| WO | WO 2010/058422 | 5/2010 |

* cited by examiner

FILM LAMINATE FOR THE PRODUCTION OF BAGS WITH AN INTEGRATED FILM HANDLE, AND METHOD FOR THE PRODUCTION OF THE LAMINATE

CROSS REFERENCE TO RELATED APPLICATIONS

Applicants claim priority under 35 U.S.C. §119 of European Application No. 10 191 569.2 filed Nov. 17, 2010, the disclosure of which is incorporated by reference.

BACKGROUND OF THE INVENTION

1. Field of the Invention

The invention relates to a film laminate from which bag packagings with an integrated film handle can be produced in a form-fill and seal bag machine.

2. The Prior Art

Within the scope of the invention, a packaging machine that works according to the so-called VFFS (vertical form fill sealing) method is referred to as a form-fill and seal bag machine. In such a bag machine that works according to the VFFS principle, the film laminate is formed into a sleeve, and sleeve sections are filled with product and sealed with sealing seams. During the entire process, the material web that forms the sleeve is moved vertically downward. VFFS form-fill and seal bag machines are primarily used for packaging solids in powder and granulate form, for example dry food for animals. They have high machine speeds, and allow efficient production and filling of bags for pourable products.

Bags that have been formed and filled in VFFS form-fill and seal bag machines can have handle punch-outs in the head region, which are introduced during the VFFS process in the form-fill and seal bag machine. A disadvantage of these bags is an often difficult combination of the handle punch-outs, placed at the head side, with opening aids, for example perforations. Also, formation of a simple removal opening is made difficult by handle punch-outs on the head side.

Therefore, bags that have a handle loop in a side surface configured as a side fold are preferably used. The handle loop is glued on or sealed on using measures known from practice. Such handle configurations hinder processing of the film laminate in a VFFS form-fill and seal film machine. In most cases, the machine speed of the form-fill and seal bag machine is so greatly impaired by affixing the film handles that the machine no longer works efficiently. For numerous bags, for example in the animal food sector, pre-finished bags are therefore used, which are individually passed to a filling machine and filled. However, producing these pre-finished bags and filling them is significantly more expensive than producing and filling bags in VFFS form-fill and seal bag machines.

Side-fold bags that have a film handle integrated into the side fold are described in German Utility Model No. DE 84 28 169 U1. The known side-fold bags are pre-finished as individual bags and filled with the material to be packaged, in a separate filling system. The bag wall of the side-fold bags consists of a film laminate that has an imprintable outer film and a sealable film glued to the outer film. In the region of a side fold, a reinforcement sheet has been laminated in between the sealable film and the outer film; this sheet is glued only to the outer film. The film handle is formed by introducing parting cuts that pass through the outer film and the reinforcement sheet connected with the outer film. The sealable inner film of the packaging remains intact and seals off the interior of the bag packaging. The handle loop formed by parting cuts makes a transition into the bag wall at its ends, in one piece with the wall.

International Application No. WO 2008/038308 A1 relates to bag packagings with an integrated handle, which are produced from a two-ply film laminate. The film laminate has an imprintable outer film as well as a sealable film glued to it. In the handle region, the outer film and the sealable film that lies on the inside are not glued together. Handle punch-outs are introduced into the outer film, so that the outer film forms a handle loop. However, the handle loop is not reinforced and therefore is only suitable for packaging products that have a low weight.

SUMMARY OF THE INVENTION

It is therefore an object of the invention to provide a material in web form, from which bags can be produced in VFFS form-fill and seal bag systems, which bags have an integrated film handle. In particular, the film handle is provided on a side surface of the bag packaging.

This object is accomplished by a laminate that comprises an outer film, a sealable film glued to the outer film, as well as a continuous reinforcement strip laminated in between the outer film and the sealable film and glued only to the outer film. A film that forms the outside of a bag packaging produced from the film laminate is referred to as an outer film. The outer film is imprintable. The reinforcement strip is narrower than the material web and extends over the entire length of the material web. The film laminate according to the invention is suitable for the production of bags with an integrated film handle, by means of a form-fill and seal bag machine, in which the film laminate is formed into a sleeve and sleeve sections are filled with product and sealed with sealing seams. The film handles are formed by introducing parting cuts into the outer film of the film laminate as well as the reinforcement strip connected with the outer film. The sealable film remains intact, in this connection. The parting cuts can be introduced in the VFFS form-fill and seal bag system or prepared in the material web before it is rolled up into a film roll. It is not possible to introduce the parting cuts into the outer film before it is glued to the sealable film, because the lamination adhesive would penetrate through the slits and glue the layers on the roll to one another.

The reinforcement strip is preferably disposed in a region of the film laminate that is shaped to form a side fold of the bag packaging, in the form-fill and seal bag machine.

The parting cuts for producing the film handles can be introduced into the film laminate by punching, or can be produced by a $CO_2$ laser beam. Laser cutting can be used without problems with non-polyolefin films, particularly films of polyethylene terephthalate (PET). PET can be cut well using $CO_2$ lasers. In the case of polyolefin films, laser cutting is problematical, because many polyolefins absorb the radiation of the $CO_2$ laser only weakly, and thus the desired cutting effect fails to occur. If PE/PE composite films are used as the film laminate, laser-absorptive active substances are added to the outer film and/or to the reinforcement strip. Mixed silicates are particularly suitable as laser-absorptive active substances.

The parting cuts are preferably delimited, at their ends, by sections that are configured in U shape or circular shape, or follow a linear section of the parting cuts, as arcs. With these sections, the introduction of force from the film handle to the wall surface of the bag packaging can be improved.

The invention also includes a method for the production of a film laminate from which bags with an integrated handle can be produced in a form-fill and seal bag machine. For the production of the film laminate, a film web of an outer film is coated with a lamination adhesive, over its full area. A material web of a sealable film is applied to the adhesive layer and pressed together with the film web as well as the adhesive layer in a lamination gap between a lamination roller and a pressing roller. A reinforcement strip is passed to the lamination gap. This strip is brought into contact with the adhesive layer, between the imprinted film web and the sealable film. The circumferential surface of the pressing roller preferably has a depression that is coordinated with the film thickness and the film width of the reinforcement strip, in such a manner that a uniform pressing pressure prevails in the lamination gap, over the entire web width of the film laminate.

Before the film laminate is wound up to form a film roll, weakening lines or parting cuts for producing film handles can be introduced into the film laminate; these only pass through the outer film and the reinforcement strips connected with the outer film. The parting cuts can be introduced into the film laminate by punching. In order to prevent intrusion of the punching tools into the sealable film, it is practical if the reinforcement strip connected with the outer film and the sealable film are passed over a metal separation sheet on both sides.

Alternatively, the parting cuts for producing the film handles can also be produced by a $CO_2$ laser. The sealable film of the film laminate regularly consists of a polyolefin, particularly polyethylene. The absorption capacity of polyethylene for the radiation of a $CO_2$ laser is low. Therefore, the risk that the sealable inner film will be weakened by the $CO_2$ laser is slight. The outer film as well as the reinforcement strip contain laser-absorptive substances, if necessary, which improve laser cutting. Mixed silicates, for example lepidolite, porphyry, phonolite, or kaolinite, are suitable as laser-absorptive substances.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
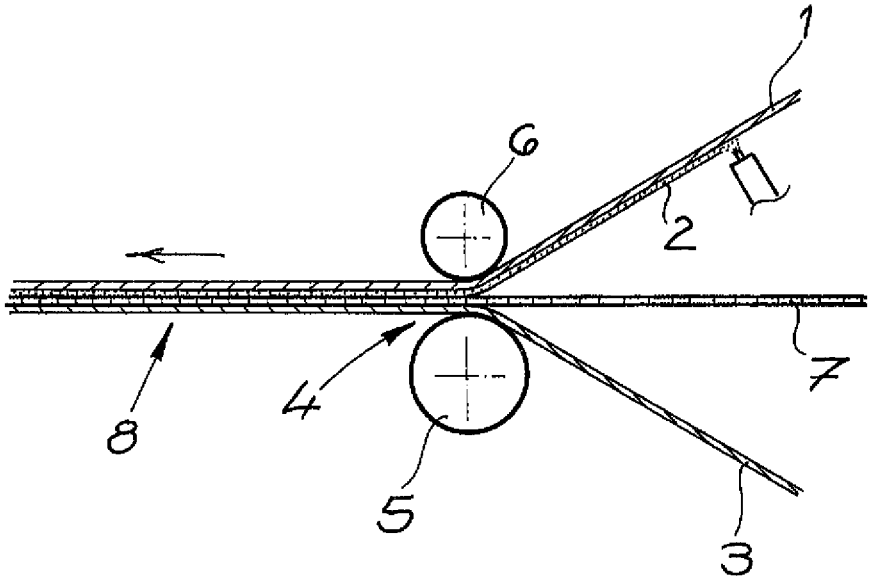
FIG. 1 shows a method for the production of a film laminate, from which bags with an integrated film handle can be produced in a VFFS form-fill and seal bag machine.

In the method shown in FIG. 1, an imprinted film web 1 is coated with a lamination adhesive 2, over its full area. A material web 3 of a sealable film is applied to the adhesive layer 2 and pressed together with film web 1 as well as adhesive layer 2 in a lamination gap 4 between a lamination roller 5 and a pressing roller 6. While this happens, a reinforcement strip 7, the width of which is less than the web width of the two film webs 1, 3, is passed to lamination gap 4. Reinforcement strip 7 extends continuously over the entire length of film laminate 8 and is brought into contact with adhesive layer 2 between imprinted film web 1 and sealable film 3. Reinforcement strip 7 is thereby firmly connected with imprinted film web 1, while it does not enter into any connection with sealable film 3.

Figure 2:
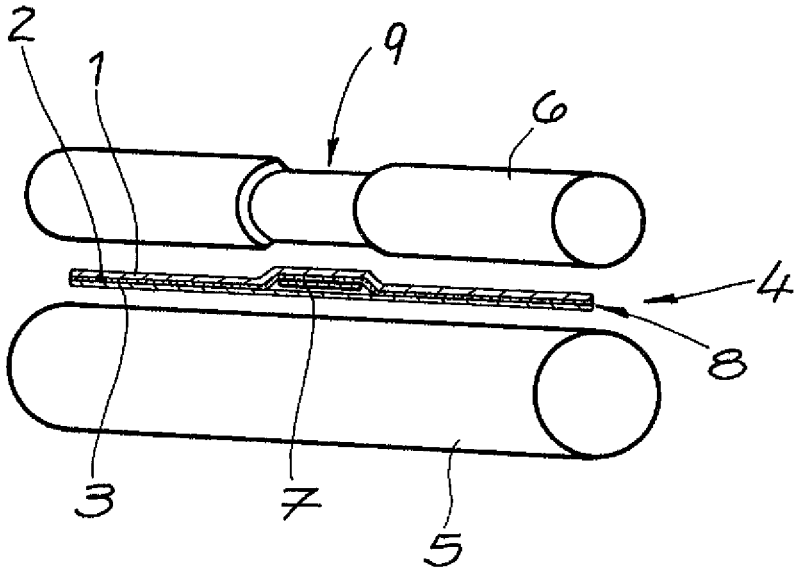
FIG. 2 shows a pressing roller arrangement for the method shown in FIG. 1.

One can see from the representation in FIG. 2 that the circumference surface of pressing roller 6 has a depression 9 that is coordinated with the film thickness and the film width of reinforcement strip 7, in such a manner that a uniform pressing pressure prevails in lamination gap 4, over the entire web width of film laminate 8.

Figure 3:
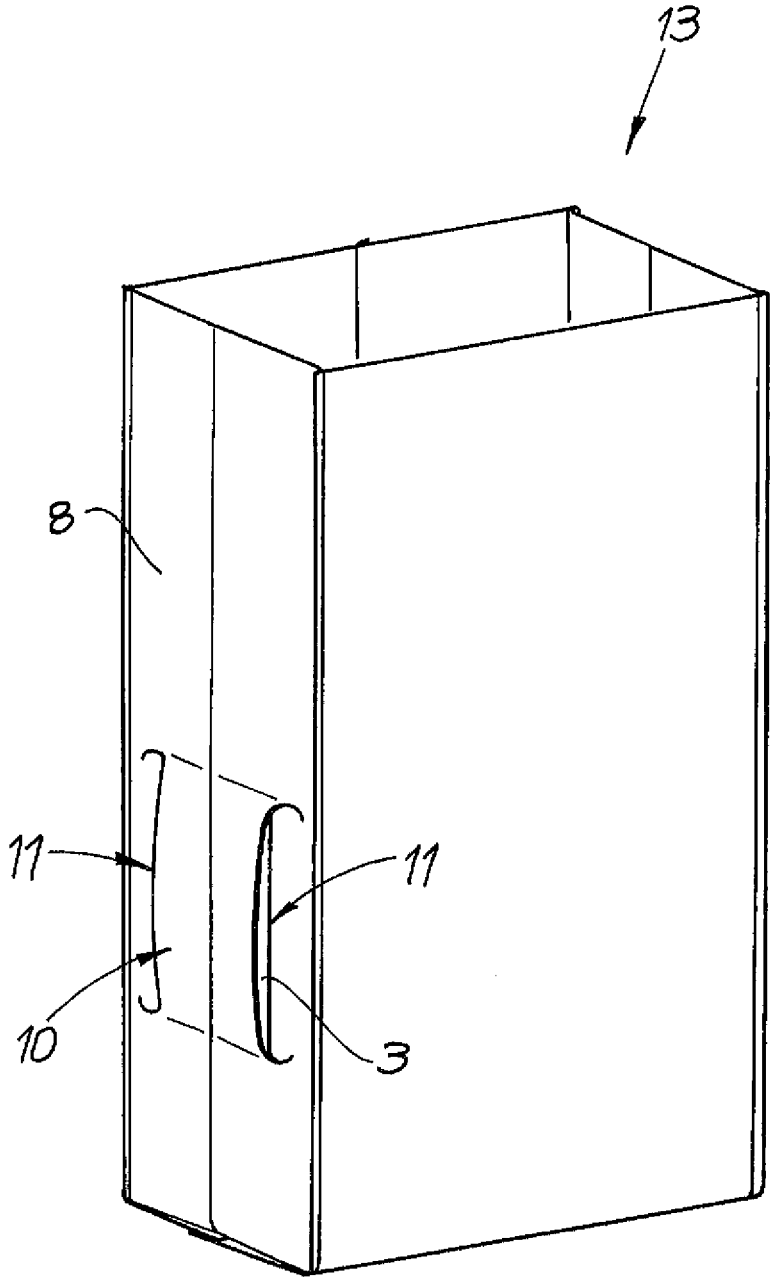
FIG. 3 shows a film bag with integrated film handle, produced using the film laminate.
Figure 4A:
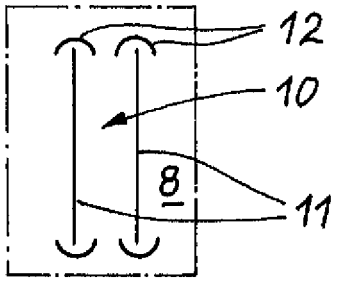
FIGS. 4*a* to 4*e* show different handle shapes produced by means of parting cuts.
Figure 4B:
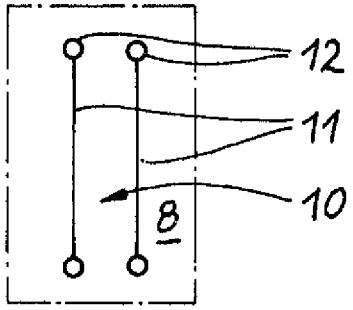
Figure 4C:
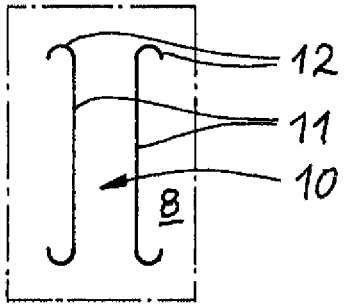
Figure 4D:
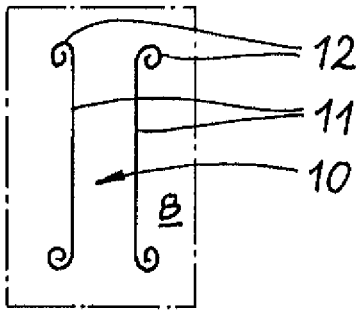
Figure 4E:
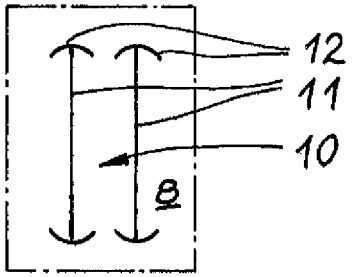
Figure 5:
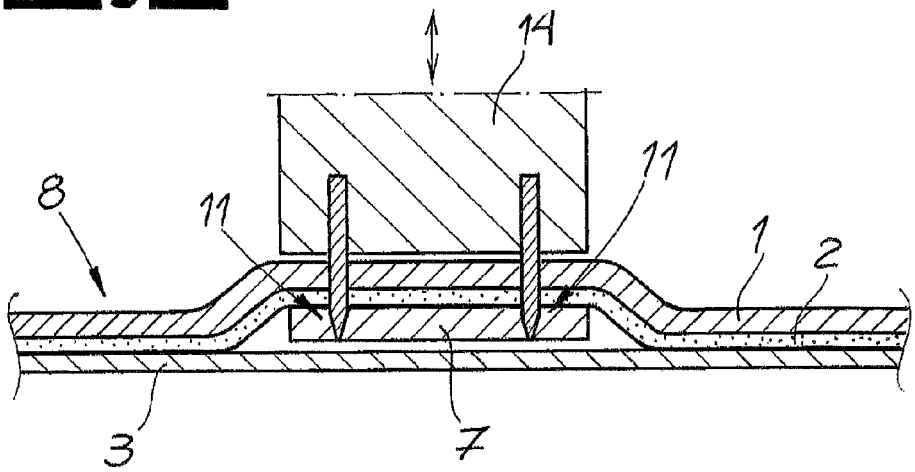
FIG. 5 shows the parting cuts being made by punching.
Figure 6:
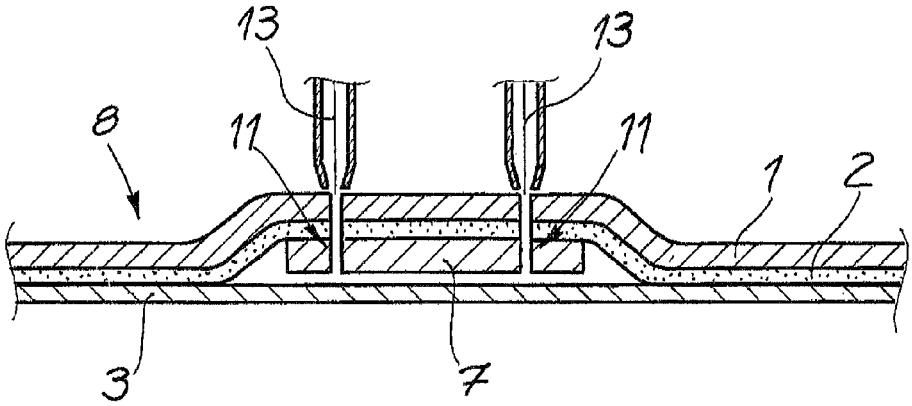
FIG. 6 shows the parting cuts being made by $CO_2$ laser.

Film handles 10 are formed in film laminate 8 by introducing parting cuts 11. Parting cuts 11 only pass through imprinted outer film 1 of film laminate 8 as well as reinforcement strip 7 connected with outer film 1, while sealable film 3 remains intact. FIG. 3 shows parting cuts 11 on a bag 13 that has been produced from film laminate 8. Parting cuts 11 can be produced by punching with a punch 14 as shown in FIG. 5 or by means of $CO_2$ laser beams 13, as shown in FIG. 6.

FIGS. 4*a* to 4*e* show different handle shapes that can be produced in the film laminate by parting cuts 11. The parting cuts 11 only pass through the outer film 1 and the reinforcement strip 7 of the film laminate 8, while the sealable film remains intact. In order to prevent the film handle 10 produced by the parting cuts 11 from continuing to tear, in an uncontrolled manner, under a load, parting cuts 11 are delimited, at their ends, by means of sections 12 that are configured in U shape, according to FIGS. 4*a* and 4*e*, or in circular shape, according to FIG. 4*b*, or follow the linear section of the parting cuts as arcs, according to the representations in FIG. 4*c* or 4*d*.

Film laminate 8 can be processed in a form-fill and seal bag machine in which the film laminate 8 is formed into a sleeve, and sleeve sections are filled with product and sealed with sealing seams. Parting cuts 11 for producing the film handle 10 can be introduced in the bag machine. However, there is also the possibility of introducing parting cuts 11 into film laminate 8 before it is wound up to form a film roll.

Accordingly, while only few embodiments of the present invention have been shown and described, it is obvious that many changes and modifications may be made thereunto without departing from the spirit and scope of the invention.

What is claimed is:

1. A method for producing bags using a form-fill and seal bag machine, comprising:

providing a film laminate comprising an outer film, a sealable film glued to the outer film and a continuous reinforcement strip laminated in between the outer film and the sealable film and glued only to the outer film, wherein the reinforcement strip extends continuously over the entire length of the film laminate and has a width which is less than the width of the two film webs;

introducing parting cuts into the outer film of the film laminate as well as the reinforcement strip connected with the outer film to form film handles, wherein the parting cuts only pass through the outer film and the reinforcement strip, while the sealable film remains intact;

thereafter forming the film laminate into a sleeve;

filling sections of the sleeve with product; and sealing the sleeve sections with sealing seams.

2. The method according to claim 1, wherein the reinforcement strip is disposed in a region of the film laminate that is formed into a side fold of the sleeve in the form-fill and seal bag machine.

3. The method according to claim 1, wherein the parting cuts for producing the film handles are introduced into the film laminate by means of punching.

4. The method according to claim 1, wherein the parting cuts for producing the film handles are produced by a $CO_2$ laser.

5. The method according to claim 4, wherein the outer film or the reinforcement strip contains laser-absorptive active substances.

6. The method according to one of claim 1, wherein ends of the parting cuts are delimited by sections that are configured in U shape or circular shape, or follow a linear section of the parting cuts, as arcs.

7. The method according to claim 1, wherein the film laminate is formed by the following steps:

(a) coating a film web of the outer film with a lamination adhesive over its full area;

(b) applying a material web of the sealable film to the adhesive layer and pressing the sealable film together with the film web and adhesive layer in a lamination gap between a lamination roller and a pressing roller;

(c) passing the reinforcement strip to the lamination gap and bringing the reinforcement strip into contact with the adhesive layer between the film web and the sealable film, wherein the reinforcement strip is thereby firmly connected with the film web and does not enter into any connection with the sealable film.

8. The method according to claim 7, wherein the pressing roller comprises a circumferential surface, which has a depression that is coordinated with a film thickness and a film width of the reinforcement strip, in such a manner that a uniform pressing pressure prevails in the lamination gap, over an entire web width of the film laminate.

* * * * *